US009919321B2

(12) United States Patent
Kim et al.

(10) Patent No.: US 9,919,321 B2
(45) Date of Patent: Mar. 20, 2018

(54) CENTRIFUGE HAVING WATER DISCHARGE STRUCTURE AND PURIFIER SYSTEM USING THE SAME

(71) Applicant: SHIN HEUNG PRECISION CO., LTD., Ulsan (KR)

(72) Inventors: Yong-Keun Kim, Ulsan (KR); Ho-Jin Eum, Ulsan (KR); In-Soo Kim, Ulsan (KR); Kyo-Hye Ye, Ulsan (KR); Yeon-Won Lee, Busan (KR); Yoon-Hwan Choi, Busan (KR)

(73) Assignee: SHIN HEUNG PRECISION CO., LTD., Ulsan (KR)

( * ) Notice: Subject to any disclaimer, the term of this patent is extended or adjusted under 35 U.S.C. 154(b) by 734 days.

(21) Appl. No.: 14/391,065

(22) PCT Filed: May 9, 2014

(86) PCT No.: PCT/KR2014/004119
§ 371 (c)(1),
(2) Date: Oct. 7, 2014

(87) PCT Pub. No.: WO2015/156445
PCT Pub. Date: Oct. 15, 2015

(65) Prior Publication Data

US 2015/0283560 A1 Oct. 8, 2015

(30) Foreign Application Priority Data

Apr. 8, 2014 (KR) ..... 10-2014-0041872

(51) Int. Cl.
*B04B 7/02* (2006.01)
*B04B 9/06* (2006.01)
(Continued)

(52) U.S. Cl.
CPC ..... *B04B 15/02* (2013.01); *B04B 5/005* (2013.01); *B04B 7/02* (2013.01); *B04B 7/04* (2013.01);
(Continued)

(58) Field of Classification Search
CPC ..... B04B 11/04; B04B 9/10; B04B 5/005; B04B 9/06; B04B 3/00; B04B 7/02;
(Continued)

(56) References Cited

U.S. PATENT DOCUMENTS 2,067,273 A * 1/1937 Carter ..... B04B 1/00 494/10
4,175,040 A * 11/1979 Sammons ..... B04B 5/06
(Continued)

FOREIGN PATENT DOCUMENTS

JP 08-177447 A 7/1996
JP 2013-066874 A 4/2013
(Continued)

*Primary Examiner* — Charles Cooley
(74) *Attorney, Agent, or Firm* — Rabin & Berdo, P.C.

(57) ABSTRACT

A centrifuge able to discharge moisture through a separate moisture outlet by separating moisture from oil when spraying oil through a nozzle of a rotor, thereby removing moisture from oil without using a separate skimmer, and a purifier system including the same. The centrifuge includes a casing, a shat, a stand tube and a rotor. The casing has an oil inlet, an oil outlet, a moisture outlet and an air inlet. Moisture separated from oil sprayed through a nozzle of the rotor is discharged along with air out of the casing through the moisture outlet. An amount of air identical to the amount of the air discharged through the moisture outlet is introduced into the casing through the air inlet.

10 Claims, 7 Drawing Sheets

(51) Int. Cl.

| | |
|---|---|
| ***B04B 13/00*** | (2006.01) |
| ***B04B 15/02*** | (2006.01) |
| ***F01M 1/10*** | (2006.01) |
| ***B04B 5/00*** | (2006.01) |
| ***B04B 15/06*** | (2006.01) |
| ***B04B 7/04*** | (2006.01) |
| ***B04B 11/02*** | (2006.01) |
| ***F01M 11/03*** | (2006.01) |

(52) U.S. Cl.
CPC ..... *B04B 9/06* (2013.01); *B04B 11/02* (2013.01); *B04B 13/00* (2013.01); *B04B 15/06* (2013.01); *F01M 1/10* (2013.01); *F01M 11/03* (2013.01); *F01M 2001/1035* (2013.01)

(58) Field of Classification Search
CPC ..... B04B 7/04; B04B 15/02; B04B 13/00; B04B 11/02; B04B 15/06; F01M 11/03; F01M 1/10; F01M 2001/1035
USPC ..... 494/24, 36, 43, 49, 56, 64, 65, 67, 83, 494/84, 901, 60, 74, 79; 210/168, 171, 210/232, 360.1, 380.1, 416.5; 184/6.24
See application file for complete search history.

(56) References Cited

U.S. PATENT DOCUMENTS

| | | | | |
|---|---|---|---|---|
| 9,737,897 | B2 * | 8/2017 | Kim | B04B 7/04 |
| 2004/0214710 | A1 * | 10/2004 | Herman | B04B 5/005 494/36 |
| 2015/0283560 | A1 * | 10/2015 | Kim | F01M 1/10 494/1 |
| 2016/0339449 | A1 * | 11/2016 | Kim | B04B 3/00 |

FOREIGN PATENT DOCUMENTS

| | | | | |
|---|---|---|---|---|
| KR | 10-0675941 | B1 | 2/2007 | |
| KR | 10-1003524 | B1 | 12/2010 | |
| KR | 10-1287153 | B1 | 7/2013 | |
| WO | WO 2007125260 | A2 * | 11/2007 | B01D 36/045 |

* cited by examiner

CENTRIFUGE HAVING WATER DISCHARGE STRUCTURE AND PURIFIER SYSTEM USING THE SAME

TECHNICAL FIELD

The present invention relates, in general, to a centrifuge having a water discharge structure and a purifier system including the same centrifuge and, more particularly, to an improved centrifuge able to discharge moisture through a separate moisture outlet by separating moisture from oil when spraying oil through a nozzle of a rotor and a purifier system including the same centrifuge able to remove impurities and moisture from oil without consuming a large amount of energy.

BACKGROUND ART

In general, a centrifuge or a centrifugal filter is an apparatus for separating, refining and concentrating a substance having a particular composition or specific gravity using centrifugal force. The centrifuge is used for filtering impurities from oil (lubricant or fuel) used in engines or a variety of machines.

FIG. 1 is a cross-sectional view showing the structure of a centrifuge of the related art.

The centrifuge shown in FIG. 1 is used for filtering impurities from oil used in engines.

The centrifuge includes a shaft 10, a rotor 20, a stand tube 30 and a casing 40. The shaft 10 has defined therein a flow path through which oil is introduced. The rotor 20 is configured to rotate about the shaft 10. The stand tube 30 is configured to rotate about the shaft 10 together with the rotor 20, and sprays oil introduced through the shaft into the rotor. The casing 40 has an oil inlet and an oil outlet, and houses the rotor 20 therein to receive oil sprayed from a nozzle 21 of the rotor 20.

The centrifuge is configured to receive oil circulated by the actuation of a pump (not shown) and subsequently filter a variety of impurities from oil using centrifugal force. More specifically, the rotor filters impurities while rotating at a high speed based on reaction principle in response to oil being sprayed through the nozzle of the rotor.

Although this centrifuge can separate and remove impurities from oil, it cannot remove moisture. Therefore, when an oil filtering system is constructed using a centrifuge, a skimmer is added in order to remove moisture from oil.

FIG. 2 is a cross-sectional view showing the structure of another centrifuge of the related art.

The centrifuge shown in FIG. 2 is configured to remove impurities as well as moisture from oil. While a rotor 50 is rotating, impurities A and moisture B move to the inner circumference and are subsequently separated from oil by centrifugal force. Moisture B separated from oil is discharged through a flow path 51 provided inside the rotor. When a preset amount of impurities A is accumulated in the inner circumference of the rotor 50, an impurity outlet 52 is opened to discharge impurities A out of the rotor 50.

As described above, this centrifuge can advantageously remove moisture from oil without using a skimmer. However, there is a contradictory problem in that water must be added in order to separate moisture or remove impurities. This also increases the contact area between water and oil, thereby creating an emulsion.

RELATED ART DOCUMENT (Patent Document 1) Korean Patent No. 1003524 (Dated Dec. 30, 2010)

DISCLOSURE

Technical Problem

Accordingly, the present invention has been made keeping in mind the above problems occurring in the related art, and the present invention is intended to propose a centrifuge able to discharge moisture through a separate moisture outlet by separating moisture from oil when spraying oil through a nozzle of a rotor, thereby removing moisture from oil without using a separate skimmer, and a purifier system including the same centrifuge.

Technical Solution

In order to achieve the above object, according to one aspect of the present invention, there is provided a centrifuge that includes: a casing having an oil inlet and an oil outlet; a shaft disposed in a top-bottom direction in the central part of the casing, the shaft guiding oil introduced through the oil inlet to the central part of the casing; a stand tube disposed rotatable about the shaft, the stand tube spraying the oil flowing through the shaft into the central part of the casing; and a rotor disposed inside the casing to define a space in which the oil sprayed from the stand tube is received and filtered while rotating together with the stand tube, the rotor having a nozzle for spraying the filtered oil into the casing. The casing has a moisture outlet through which moisture separated from the oil sprayed through the nozzle is discharged along with air out of the casing and an air inlet through which an amount of air identical to an amount of the air discharged through the moisture outlet is introduced into the casing.

In the centrifuge, the air inlet may be disposed at a position below the moisture outlet, and the air inlet and the moisture outlet may be positioned at both sides of the rotor to oppose each other.

In the centrifuge, the centrifuge may further include a reducer disposed on the upper end of the rotor. The reducer may have a plurality of flow holes, the total of flow areas of which is greater than the flow area of the moisture outlet. The reducer may reduce the introduction of oil scattering between the rotor and the shaft into the moisture outlet.

In the centrifuge, the flow area of the air inlet may be smaller than the flow area of the moisture outlet.

According to another aspect of the present invention, there is provided a purifier system that includes: a centrifuge, wherein the centrifuge includes: a casing having an oil inlet and an oil outlet; a shaft disposed in a top-bottom direction in the central part of the casing, the shaft guiding oil introduced through the oil inlet to the central part of the casing; a stand tube disposed rotatable about the shaft, the stand tube spraying the oil flowing through the shaft into the central part of the casing; and a rotor disposed inside the casing to define a space in which the oil sprayed from the stand tube is received and filtered while rotating together with the stand tube, the rotor having a nozzle for spraying the filtered oil into the casing. The casing has a moisture outlet through which moisture separated from the oil sprayed through the nozzle is discharged along with air out of the casing and an air inlet through which an amount of air identical to an amount of the air discharged through the moisture outlet is introduced into the casing. The purifier system also includes: a blower disposed on a discharge pipe extending from the casing, through which the air discharged through the moisture outlet flows, the blower taking in and blowing air from the casing; a moisture remover connected to the discharge pipe to receive the air supplied through the discharge pipe and remove moisture from the received air; circulation piping connecting the moisture remover to the casing such that the air from which the moisture is removed by the moisture remover is fed into the casing through the air inlet; and a controller having the function of controlling the blower.

In the purifier system, the air inlet may be disposed at a position below the moisture outlet, and the air inlet and the moisture outlet may be positioned at both sides of the rotor to oppose each other.

In the purifier system, the centrifuge may further include a reducer disposed on the upper end of the rotor. The reducer may have a plurality of flow holes, the total of flow areas of which is greater than the flow area of the moisture outlet. The reducer may reduce the introduction of oil scattering between the rotor and the shaft into the moisture outlet.

In the purifier system, the flow area of the air inlet may be smaller than the flow area of the moisture outlet.

In the purifier system, the moisture remover may include a coil through which cold refrigerant or cooling water circulates, such that moisture in the air blown by the blower is condensed when the air comes into contact with the coil.

In the purifier system, the moisture remover may be an eliminator including a plurality of overlapping nets, each of which is formed of a plurality of fine wires, such that moisture is removed from air while the air is passing through the overlapping nets.

The purifier system may further include: a container containing condensed water produced through the condensation of moisture by the moisture remover; and a level sensor disposed on the container to detect a change in level of the condensed water. The controller may selectively operate the blower and the moisture remover based on a value of the change in the level of the condensed water detected by the level sensor.

According to the present invention having the above-described characteristics, it is possible to discharge moisture through the separate moisture outlet by separating moisture from oil when spraying oil through the nozzle of the rotor, thereby removing moisture from oil without using a separate skimmer.

In addition, since it is not required to heat oil when removing moisture from oil, it is possible to save the amount of energy consumed compared to the related-art skimmer that separates moisture by heating oil.

Figure 1:
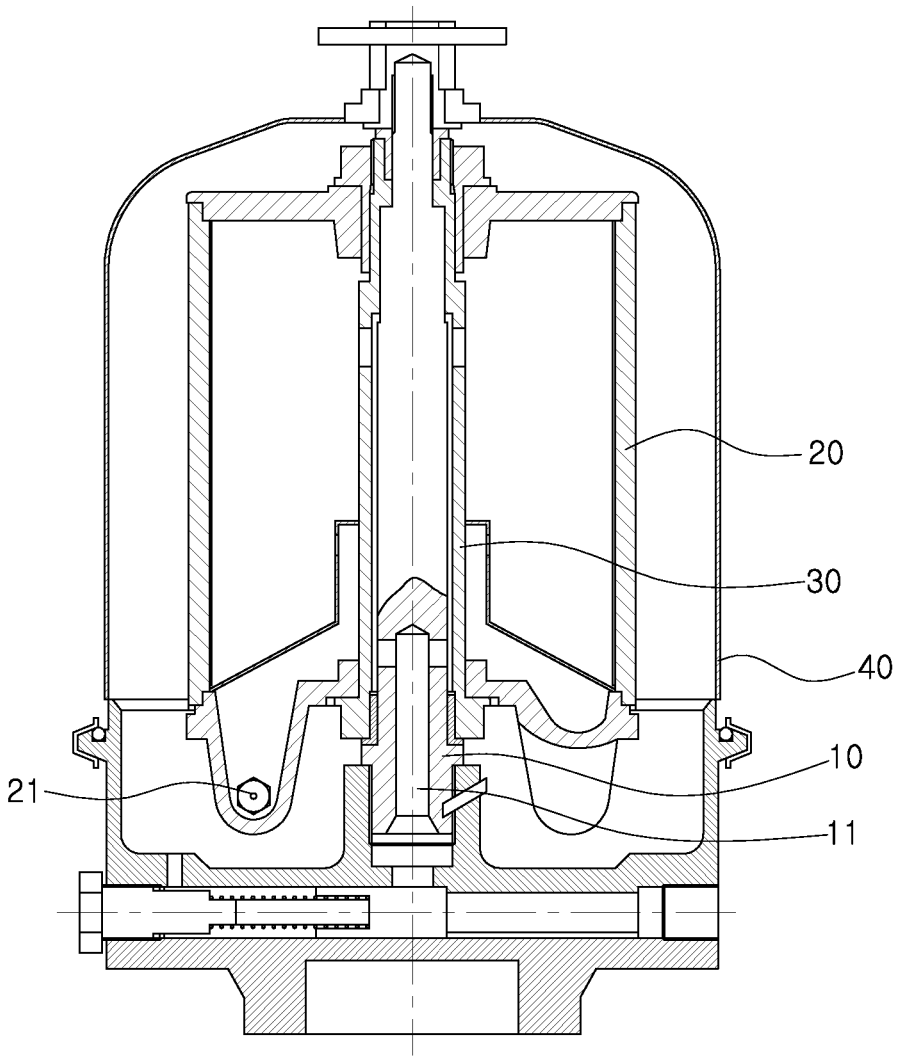
FIG. 1 (PRIOR ART)
FIG. 1 is a cross-sectional view showing the structure of a centrifuge of the related art.

<Description of the Reference Numerals in the Drawings>

| | |
|---|---|
| 100: centrifuge | 110: casing |
| 111: oil inlet | 112: oil outlet |
| 113: moisture outlet | 114: air inlet |
| 120: shaft | 130: stand tube |
| 140: rotor | 141: nozzle |
| 150: reducer | 151: flow holes |
| 200: blower | 210: discharge pipe |
| 300: moisture remover | 301: coil |
| 302: eliminator | 330: container |
| 340: level sensor | 370: circulation piping |
| 400: controller | |

MODE FOR INVENTION

Hereinbelow, preferred embodiments of the present invention will be described in detail with reference to the accompanying drawings. In the following description, it is to be noted that, when the functions of conventional elements and the detailed description of elements related with the present invention may make the gist of the present invention unclear, a detailed description of those elements will be omitted.

Figure 3:
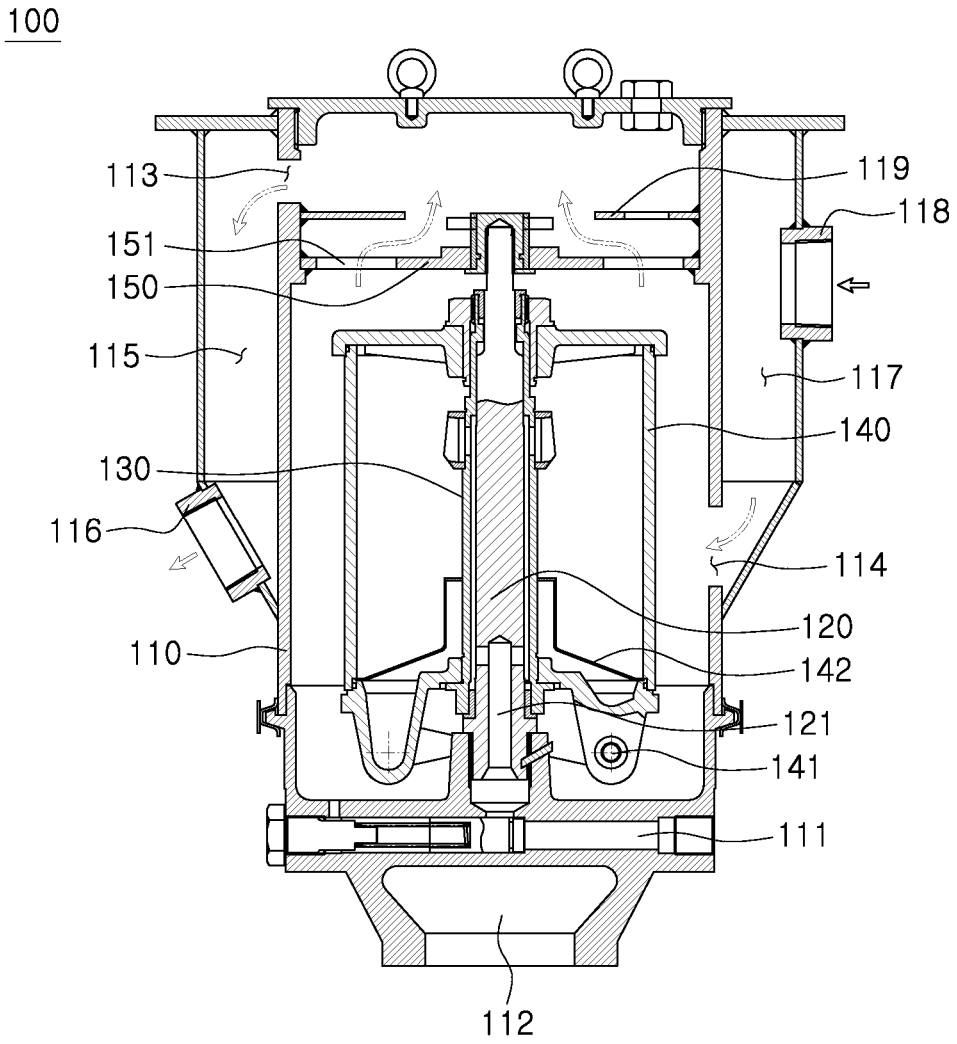
FIG. 3 is a cross-sectional view showing the structure of a centrifuge according to an exemplary embodiment of the present invention.
Figure 4:
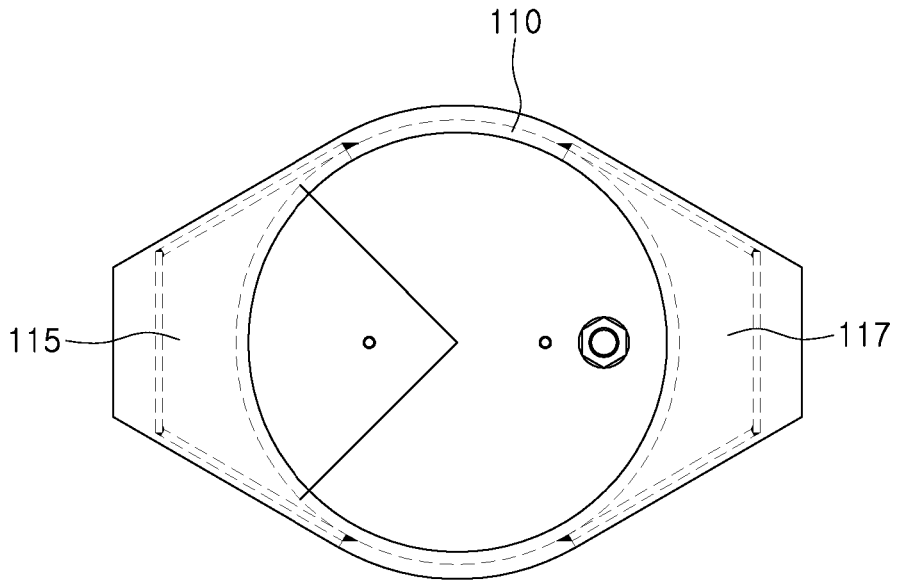
FIG. 4 is a top-plan view showing the structure of the centrifuge according to an exemplary embodiment of the present invention.
Figure 5:
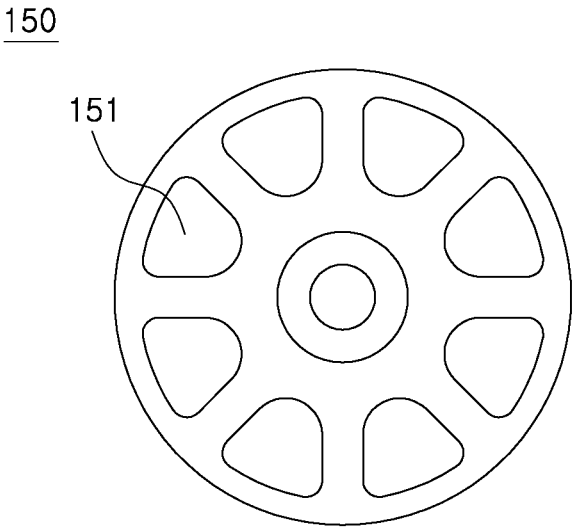
FIG. 5 is a top-plan view showing the structure of a reducer according to an exemplary embodiment of the present invention.

FIG. 3 is a cross-sectional view showing the structure of a centrifuge according to an exemplary embodiment of the present invention, FIG. 4 is a top-plan view showing the structure of the centrifuge according to an exemplary embodiment of the present invention, and FIG. 5 is a top-plan view showing the structure of a reducer according to an exemplary embodiment of the present invention.

The centrifuge 100 according to an exemplary embodiment of the present invention includes a casing, a shaft 120, a stand tube 130 and a rotor 140. The casing 110 has a moisture outlet 113 and an air inlet 114 such that moisture separated from oil can be separately discharged.

For reference, the applicant recognized that moisture is separated from oil while filtered oil is sprayed through a nozzle 141 disposed on a rotor 140, and based on this discovery, enabled moisture separated from oil to be discharged through a separate moisture outlet 113, thereby adding the process of removing moisture from oil to the process of filtering oil using the centrifuge.

Hereinafter, components of the centrifuge 100 having the moisture discharge structure according to the present invention will be described in detail.

The casing 110 houses the shaft 120, the stand tube 130 and the rotor 140 therein while forming the outer structure of the centrifuge 100. The casing 110 has an oil inlet 111 and an oil outlet 112 on the lower end. This configuration is substantially the same as that of the existing centrifuges.

Unlike the existing centrifuges, the casing 110 of the centrifuge 100 according to the present invention further has the moisture outlet 113 through which moisture separated from oil can be discharged out of the casing 110 through a flow path different from that of air from the casing 110 and the air inlet 114 through which an amount of air identical to the amount of air discharged through the moisture outlet 113 can be introduced into the casing 110.

The moisture outlet 113 is provided substantially on the upper end of one side of the casing 110, and the air inlet 114 is provided on the lower end of the other side of the casing 110. The moisture outlet 113 and the air inlet 114 are positioned on both sides of the rotor 140 such that they oppose each other. For example, FIG. 3 shows the structure in which the moisture outlet 113 is provided on the left upper end of the casing 110 and the air inlet 114 is provided on the right lower end of the casing 110.

According to this structure of the moisture outlet 113 and the air inlet 114, air inside the casing flows toward the moisture outlet 113 while forming an upward current in response to the flow of air introduced into the casing 110 through the air inlet 114, whereby efficient discharge of air and moisture can be induced.

In addition, the flow area of the air inlet 114 is smaller than the flow area of the moisture outlet 113. A rapid current of air discharged out of the casing 110 through the moisture outlet 113 increases the possibility that oil particulates within the casing 110 will exit along with air. Therefore, when the flow area of the moisture outlet 113 is set greater than the flow area of the air inlet 114, it is possible to reduce oil particulates exiting along with air. The flow area of the air outlet 114 mentioned herein indicates the cross-sectional area of the flow path defined by the air inlet 114 when the air inlet 114 is cut in the lateral direction with respect to the flowing direction of air that is introduced through the air inlet 114. The flow area of the moisture outlet 113 mentioned herein indicates the cross-sectional area of the flow path defined by the moisture outlet 113 when the moisture outlet 113 is cut in the lateral direction with respect to the flowing direction of air that is discharged through the moisture outlet 113.

A first auxiliary chamber 115 is disposed in an outer part of the casing 110 where the moisture outlet 113 is formed. Air that is discharged through the moisture outlet 113 can temporarily stay in the first auxiliary chamber 115. A pipe connector 116 is disposed on the lower end of the first auxiliary chamber 115. The pipe connector 116 is connected to a discharge pipe 210, which will be described later.

Likewise, a second auxiliary chamber 117 is disposed in an outer part of the casing 110 where the air inlet 114 is formed. Air that is to enter the air inlet 114 can temporarily stay in the second auxiliary chamber 117. A pipe connector 118 is disposed in the central portion of the second auxiliary chamber 117. The pipe connector 118 is connected to circulation piping 370, which will be described later.

The pipe connector 118 disposed on the second auxiliary chamber 117 is positioned higher than the pipe connector 116 disposed on the first auxiliary chamber 115.

The shaft 120, the stand tube 130 and the rotor 140 will be described in brief since they can be configured the same as those of the related-art centrifuge.

The shaft 120 is disposed in the top-bottom direction in the central part of the casing 110, and has a flow path 121 through which oil introduced through the oil inlet 111 flows to the stand tube 130.

The stand tube 130 is configured to spray oil introduced through the shaft 120 into the rotor 140 while rotating together with the rotor 140 about the shaft 120.

The rotor 140 is configured to receive oil sprayed from the stand tube 130 while rotating together with the stand tube 130. The rotor 140 has a paper member (not shown) on the inner wall that absorbs impurities sprayed together with oil. A separation film 142 is disposed inside the rotor 140 to divide the inside of the rotor 140 into an upper space and a lower space such that filtered oil can be separately discharged. The nozzle 141 that sprays filtered oil into the casing 110 is disposed on the lower end of the rotor 140.

A gap is defined between the rotor 140 and the shaft 120 in order to minimize friction occurring between the shaft 120 and the rotor 140 when the rotor 140 rotates 140, and oil consequently scatters through this gap when the rotor 140 rotates. In order to prevent oil scattering through the gap from being discharged out of the casing 110 through the moisture outlet 113 and minimize an increase in the flow rate of air in response to a significant decrease in the flow area of air of the moisture outlet 113, the reducer 150 is disposed on the upper end of the rotor 140.

The reducer 150 is disposed as a stationary structure on the upper part of the rotor 140 in order to form a partition that prevents oil particulates scattering from the gap between the shaft 120 and the rotor 140 from directly entering the moisture outlet 113. The reducer 150 has a plurality of flow holes 151 through which air and moisture can flow.

It is preferable that a total of the flow areas of the plurality of flow holes 151 formed on the reducer 150 be greater than the flow area of the moisture outlet 113. Consequently, when air is discharged through the moisture outlet 113, the possibility that oil particulates exit becomes higher in proportion to the discharge speed of air.

Therefore, when the total of the flow areas of the flow holes 151 in the reducer 150 is greater than the flow area of the moisture outlet 113, it is possible to reduce oil particulates exiting together with air through the moisture outlet 113 in response to the flow rate of discharged air being accelerated due to a significant decrease in the flow area of the moisture outlet 113.

For reference, the flow areas of the flow holes 151 mentioned above indicate the cross-sectional areas of the flow paths defined by the flow holes 151 when the flow holes 151 are cut in the lateral direction. The total of the flow areas of the flow holes 151 is greater than the flow area of the moisture outlet 113.

In FIG. 3, reference numeral 119 indicates a bracket having a hole through which a revolution per minute (RPM) sensor for measuring the rotation velocity of the rotor extends.

In the centrifuge 100 having the above-described moisture discharge structure according to the present invention, moisture separated from oil in the process of spraying filtered oil through the nozzle 141 flows upwards along with air and is subsequently discharged out of the casing 110 through the moisture outlet 113 formed in the casing 110, an amount of replacement air identical to the amount of air exiting through the moisture outlet 113 is introduced into the casing 110 through the air inlet 114, and oil sprayed into the casing 110 through the nozzle 141 is discharged into an oil tank (not shown) through the oil outlet 112 formed in the lower end of the casing 110.

In addition, in order to prevent oil and the centrifuge from being contaminated by oil that is introduced into the casing 110 through the air inlet 114, it is preferable that moisture is removed from filtered air or air discharged through the moisture outlet 113 and subsequently air is circulated to enter the casing 110 through the air inlet 114.

As described above, according to the invention, the moisture outlet 113 is added to the related-art centrifuge, such that moisture is discharged along a separate path different from that of oil. Advantageously, it is possible to separate moisture during the oil filtering process without using a separate skimmer.

Figure 6:
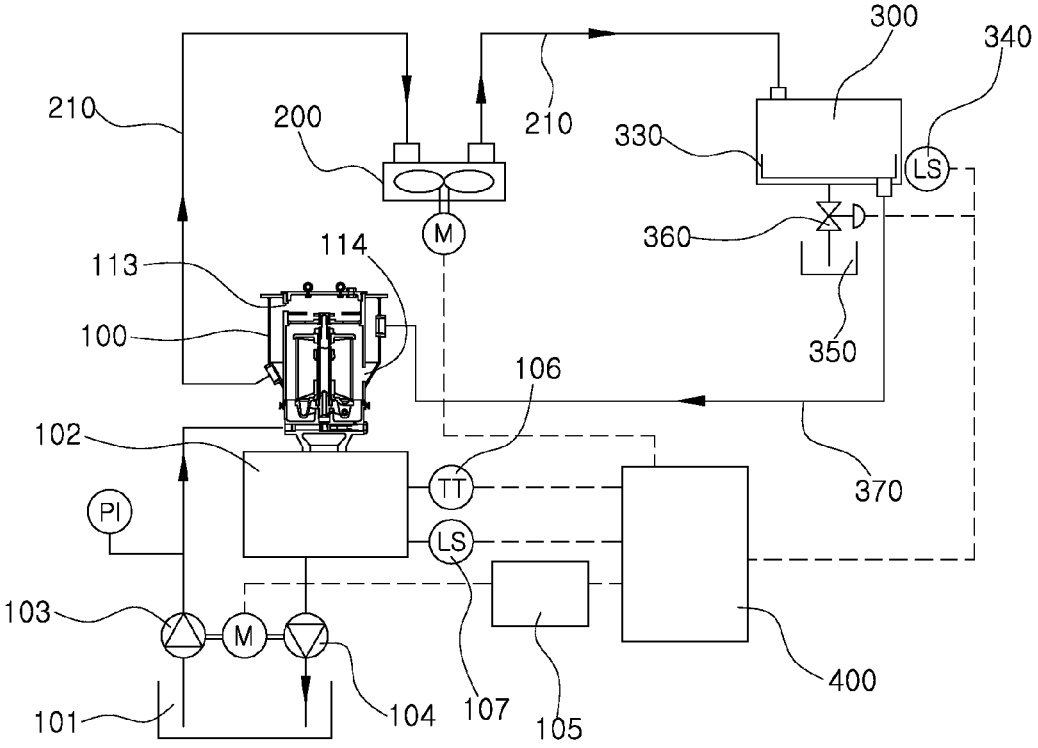
FIG. 6 is a configuration view showing a purifier system according to an exemplary embodiment of the present invention.
Figure 7:
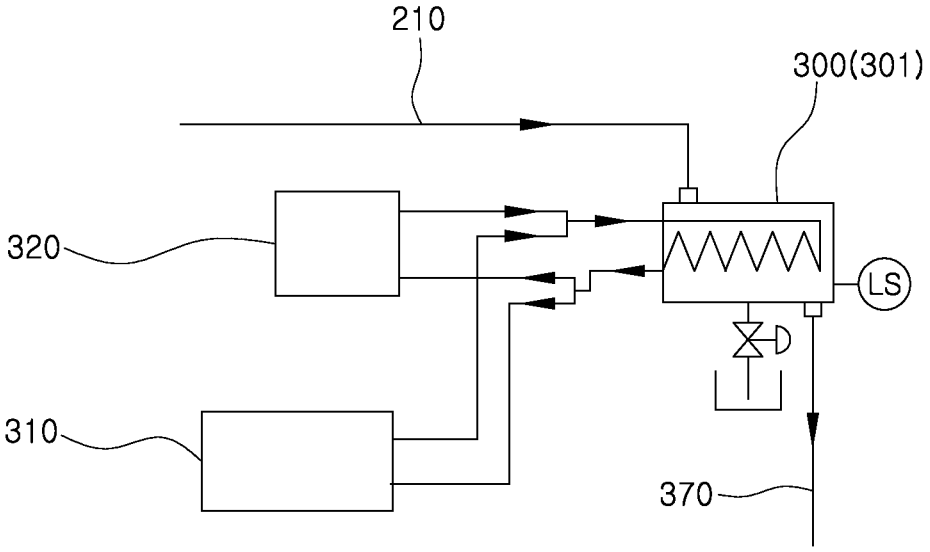
FIG. 7 is a configuration view showing a moisture remover that removes moisture using refrigerant or cooling water.
Figure 8:
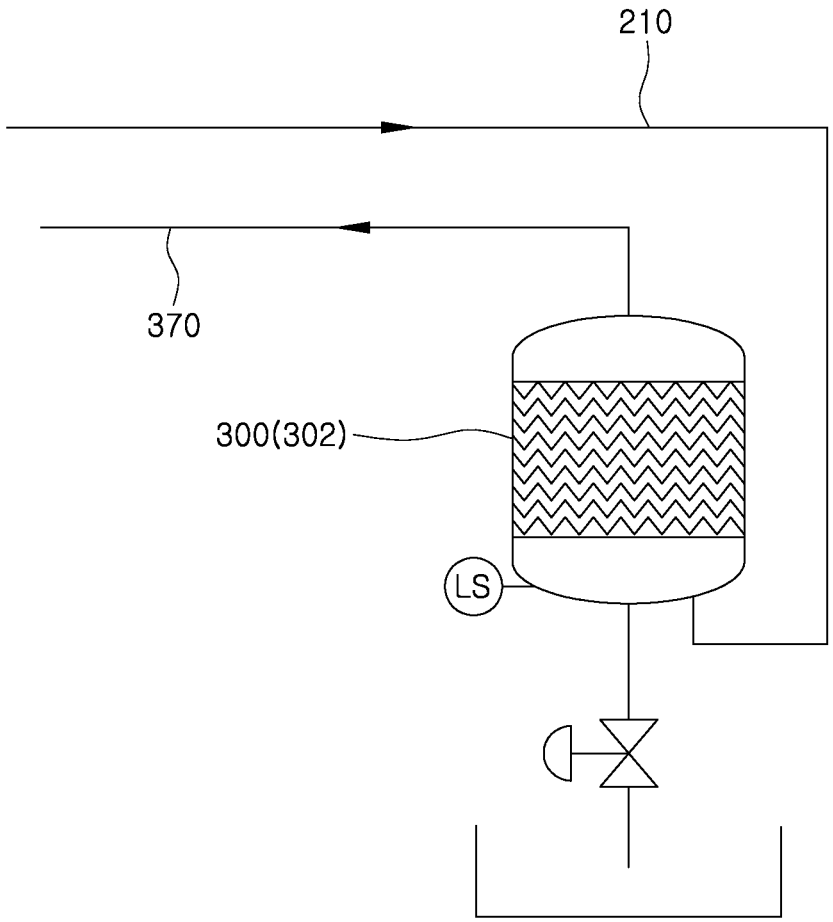
FIG. 8 is a configuration view showing the moisture remover configured as an eliminator.

FIG. 6 is a configuration view showing a purifier system according to an exemplary embodiment of the present invention, FIG. 7 is a configuration view showing a moisture remover that removes moisture using refrigerant or cooling water, and FIG. 8 is a configuration view showing the moisture remover configured as an eliminator.

The purifier system according to the present invention includes the centrifuge 100 having the above-described moisture discharge structure, and is configured to remove impurities and moisture from oil.

The purifier system includes the centrifuge 100, a blower 200, a moisture remover 300 and a controller 400.

A description of the structure of the centrifuge 100 will be omitted since the centrifuge 100 has been described above with reference to FIG. 3 to FIG. 5.

The blower 200 is disposed on the discharge pipe 210 that extends from the casing 110, and allows air discharged from the moisture outlet 113 in the casing 110 to flow. Due to the operation of the blower 200, air and moisture within the casing 110 are introduced into the discharge pipe 210 through the moisture outlet 113, and subsequently flow through the discharge pipe 210 to feed to the moisture remover 300.

The moisture remover 300 is configured to remove moisture from air blown by the blower 200, and is connected to the discharge pipe 210. The moisture remover 300 may include a coil 301 through which cold refrigerant or cooling water circulates such that moisture in air condenses on the coil surface due to heat exchange between air and cooling water or be implemented as a known eliminator that removes liquid particulates from an air current.

For reference, FIG. 7 shows the moisture remover 300 including the coil 301, which removes moisture from air by selectively receiving cooling water fed from a low-temperature refrigerant or cooling water source 320 produced from a freezer 310. FIG. 8 shows the moisture remover 300, which removes moisture from air using the eliminator 302.

The eliminator 302 is a device that includes a plurality of overlapping nets, each of which is formed of a plurality of fine wires. The eliminator 302 removes moisture from air by allowing air to pass through the overlapping nets. A detailed description of the eliminator 302 will be omitted since it is widely used.

When the moisture remover 300 is configured as this eliminator, additional energy for actuating the moisture remover 300 is not consumed. Thus, it is advantageously possible to reduce energy required for actuating the purifier system.

In addition, it is possible to dispose the moisture remover 300 including the coil 301, which removes moisture using refrigerant or cooling water, and the moisture remover 300 configured as the eliminator 302 in a parallel structure, such that air can be blown to one of the moisture removers 300 as selected by a user.

The moisture remover 300 configured as above has a container 330, which contains condensed water produced through the condensation of moisture. In addition, a level sensor 340 for detecting a change in the surface level of cooling water contained in the container 330 is disposed on the container 330.

It is preferable that the blower 200 and the moisture remover 300 stop operating in order to prevent unnecessary energy consumption if moisture in oil is equal to or less than an allowable value. Although it is preferable to detect the moisture content of oil and selectively operate the blower 200 and the moisture remover 300 based on the result of the detection, there is a problem in that a moisture sensor is expensive.

Accordingly, the present invention employs the level sensor 340 instead of the moisture sensor, which detects the moisture content of oil. The level sensor 340 detects changes in the amount of cooling water produced by the moisture remover 300. If the detected amount is equal to or less than a preset value, it is determined that the moisture content in oil is within a suitable range. The blower 200 and the moisture remover 300 are subsequently stopped operating for a preset time. After the preset time, the blower 200 and the moisture remover 300 are restarted, and changes in the amount of condensed water are detected.

The level sensor 340 can be configured as a buoy, the position of which varies according to the amount of condensed water within the container 330, or a capacitive level sensor. Since a specific structure is not required for the level sensor 340 to detect changes in the level of condensed water, the level sensor 340 can be implemented as not only the above-mentioned buoy or capacitive level sensor, but also a variety of known sensors that detect changes in water level.

In FIG. 6, reference numeral 350 indicates a tank in which condensed water discharged from the container 330 is contained. When condensed water reaches a preset water level within the container 330, the level sensor 340 detects the condensed water reached the preset water level and generates a detection signal. The controller 400 opens a valve 360 disposed between the container 330 and the tank 350 in response to the detection signal, whereby condensed water is discharged from the container 330 to the tank 350.

The moisture remover 300 is connected to the casing 110 by means of the circulation piping 370, thereby forming a circulation structure that returns air from which moisture is removed to the centrifuge 100.

As the air circulation structure is formed by the moisture remover 300 and the casing 110 by means of the circulation piping 370, it is possible to prevent oil and centrifuge 100 from being contaminated due to the introduction of external air and prevent fires due to the introduction of ignitable substances.

The controller 400 is configured to control the overall purifier system, and includes the function of controlling the blower 200 and the moisture remover 300.

For reference, in FIG. 6, reference numeral 101 indicates a tank containing oil to be processed; 102 indicates a clean oil tank containing oil filtered by the centrifuge 100; 103 indicates a pump that propels oil contained in the oil tank 101 to the centrifuge 100; 104 indicates a pump that returns oil contained in the clean oil tank 102 to the oil tank 101; 105 indicates an inverter; 106 indicates a temperature sensor that detects the temperature of oil contained in the clean oil tank 102; and 107 indicates a level sensor that detects the level of oil contained in the clean oil tank. A detailed description of this oil circulation structure will be omitted since the oil circulation structure is already used in systems that filter oil using a centrifuge.

The controller 400 determines whether or not to operate the blower 200 and the moisture remover 300 and controls the operation of the blower 200 and the moisture remover 300 based on information on the level of cooling water within the container 330 provided in the moisture remover 300, transferred from the level sensor 340 disposed on the container 330.

More specifically, the controller 400 detects a change in the level of cooling water within the container 330 by receiving information on the level of cooling water from the level sensor 340 by preset time intervals. If a change in the level of cooling water is within a preset range, the controller 400 determines that removal of moisture from oil is not required and subsequently stops the operation of the blower 200 and the moisture remover 300. In this case, the purifier system filters impurities from oil while circulating oil from the oil tank to the centrifuge like simple filter systems using the related-art centrifuge.

In addition, it is preferable that the controller 400 cut off the flow paths of the discharge pipe 210 and the circulation piping 370 using valves (not shown) when stopping the operation of the blower 200 and the moisture remover 300.

Of course, when a change in the level of cooling water is beyond the preset range, the controller 400 determines that continuous removal of moisture is required and subsequently controls the blower 200 and the moisture remover 300 to continuously operate.

After a preset time has elapsed from the point of time when the operations of the blower 200 and the moisture remover 300 are stopped, the controller 400 detects a change in the level of cooling water by operating the blower 200 and the moisture remover 300 again and subsequently determines whether or not to continue operating the blower 200 and the moisture remover 300. This process is continuously repeated.

Therefore, the purifier system according to the present invention can selectively operate in a centrifugation mode to remove impurities from oil or in a purification mode to remove impurities as well as moisture from oil according to changes in the level of cooling water.

Figure 2:
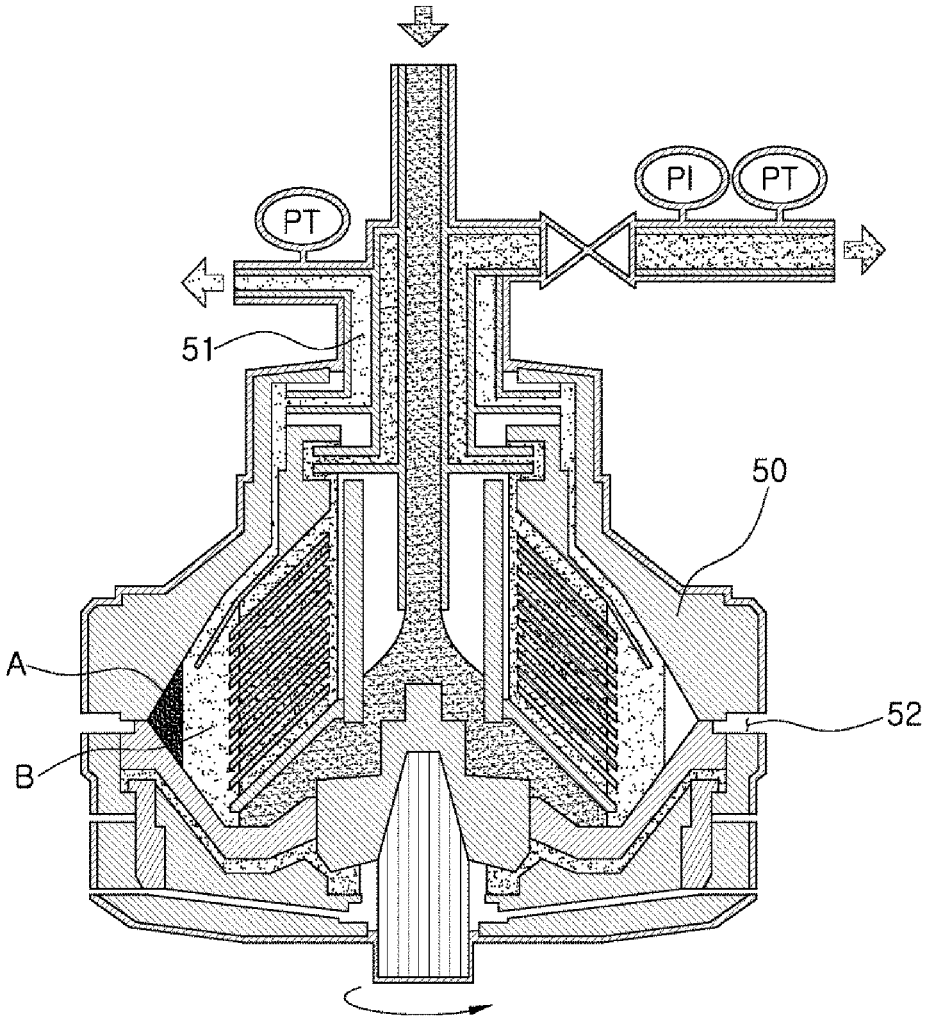
FIG. 2 (PRIOR ART)
FIG. 2 is a cross-sectional view showing the structure of another centrifuge of the related art.

When the purifier system according to the present invention as configured above removes moisture from oil, additional heating is not required. It is therefore possible to save energy consumed in cleaning oil (removing impurities and moisture). Unlike in the centrifuge illustrated with reference to FIG. 2, water and oil are not in contact with each other while water is being separated from oil in the purifier system according to the present invention. Thus, it is advantageously possible to more reliably remove moisture from oil.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A centrifuge comprising:

a casing having an oil inlet and an oil outlet;

a shaft disposed in a top-bottom direction in a central part of the casing the shaft guiding oil introduced through the oil inlet to the central part of the casing;

a stand tube disposed rotatable about the shaft, the stand tube spraying the oil flowing through the shaft into the central part of the casing;

a rotor disposed inside the casing to define a space in which the oil sprayed from the stand tube is received and filtered while rotating together with the stand tube, the rotor comprising a nozzle for spraying the filtered oil into the casing;

a moisture outlet formed in the casing, through which moisture separated from the oil sprayed through the nozzle is discharged along with air out of the casing;

an air inlet formed in the casing, through which an amount of air identical to an amount of the air discharged through the moisture outlet is introduced into the casing; and a reducer disposed on an upper end of the rotor, the reducer having a plurality of flow holes, a total of flow areas of which is greater than a flow area of the moisture outlet, and the reducer reducing an introduction of oil scattering between the rotor and the shaft into the moisture outlet.

2. The centrifuge according to claim 1, wherein the air inlet is disposed at a position below the moisture outlet, and the air inlet and the moisture outlet are positioned at both sides of the rotor to oppose each other.

3. The centrifuge according to claim 1, wherein a flow area of the air inlet is smaller than a flow area of the moisture outlet.

4. A purifier system comprising:

a centrifuge, wherein the centrifuge comprises: a casing having an oil inlet and an oil outlet; a shaft disposed in a top-bottom direction in a central part of the casing, the shaft guiding oil introduced through the oil inlet to the central part of the casing; a stand tube disposed rotatable about the shaft, the stand tube spraying the oil flowing through the shaft into the central part of the casing; a rotor disposed inside the casing to define a space in which the oil sprayed from the stand tube is received and filtered while rotating together with the stand tube, the rotor comprising a nozzle for spraying the filtered oil into the casing; a moisture outlet formed in the casing, through which moisture separated from the oil sprayed through the nozzle is discharged along with air out of the casing; and an air inlet formed in the casing, through which an amount of air identical to an amount of the air discharged through the moisture outlet is introduced into the casing;

a blower disposed on a discharge pipe extending from the casing, through which the air discharged through the moisture outlet flows, the blower taking in and blowing air from the casing;

a moisture remover connected to the discharge pipe to receive the air supplied through the discharge pipe and remove moisture from the received air;

circulation piping connecting the moisture remover to the casing such that the air from which the moisture is removed by the moisture remover is fed into the casing through the air inlet; and a controller having a function of controlling the blower.

5. The purifier system according to claim 4, wherein the air inlet is disposed at a position below the moisture outlet, and the air inlet and the moisture outlet are positioned at both sides of the rotor to oppose each other.

6. The purifier system according to claim 4, wherein the centrifuge further comprises a reducer disposed on an upper end of the rotor, the reducer having a plurality of flow holes, a total of flow areas of which is greater than a flow area of the moisture outlet, and the reducer reducing an introduction of oil scattering between the rotor and the shaft into the moisture outlet.

7. The purifier system according to claim 4, wherein a flow area of the air inlet is smaller than a flow area of the moisture outlet.

8. The purifier system according to claim 4, wherein the moisture remover comprises a coil through which cold refrigerant or cooling water circulates, such that moisture in the air blown by the blower is condensed when the air comes into contact with the coil.

9. The purifier system according to claim 4, wherein the moisture remover comprises an eliminator including a plurality of overlapping nets, each of which is formed of a plurality of fine wires, such that moisture is removed from air while the air is passing through the overlapping nets.

10. The purifier system according to claim 4, further comprising:

a container containing condensed water produced through condensation of moisture by the moisture remover; and a level sensor disposed on the container to detect a change in level of the condensed water, wherein the controller selectively operates the blower and the moisture remover based on a value of the change in the level of the condensed water detected by the level sensor.

* * * * *